US007950546B2

(12) United States Patent
Giraud et al.

(10) Patent No.: US 7,950,546 B2
(45) **Date of Patent: *May 31, 2011**

(54) RE-SEALABLE MOISTURE TIGHT CONTAINERS FOR STRIPS AND THE LIKE HAVING ALTERNATIVE SEALING MECHANISMS

(75) Inventors: Jean-Pierre Giraud, Paris (FR); Michel Zbirka, Jouy-sur-Morin (FR)

(73) Assignee: CSP Technologies, Inc., Amsterdam, NY (US)

( * ) Notice: Subject to any disclaimer, the term of this patent is extended or adjusted under 35 U.S.C. 154(b) by 1068 days.

This patent is subject to a terminal disclaimer.

(21) Appl. No.: 11/577,554

(22) PCT Filed: Oct. 20, 2005

(86) PCT No.: PCT/US2005/038015

§ 371 (c)(1), (2), (4) Date: Apr. 19, 2007

(87) PCT Pub. No.: WO2006/045087

PCT Pub. Date: Apr. 27, 2006

(65) Prior Publication Data

US 2008/0135568 A1 Jun. 12, 2008

(51) Int. Cl.

| | |
|---|---|
| ***B65D 41/16*** | (2006.01) |
| ***B65D 43/18*** | (2006.01) |
| ***B65D 83/04*** | (2006.01) |
| ***B65D 51/04*** | (2006.01) |
| *B65H 1/00* | (2006.01) |

(52) U.S. Cl. ..... 220/793; 220/810; 220/839; 220/254.1; 220/259.3; 221/45; 206/535

(58) Field of Classification Search ..... 220/839, 220/628, 630, 254.1, 254.3, 810, 793; 206/535; 215/235; 221/45, 63, 33

See application file for complete search history.

(56) References Cited

U.S. PATENT DOCUMENTS 3,784,055 A 1/1974 Anderson (Continued)

FOREIGN PATENT DOCUMENTS

CA 2428862 11/2004

(Continued)

*Primary Examiner* — Robin Hylton

(74) *Attorney, Agent, or Firm* — Greenberg Traurig, LLP

(57) ABSTRACT

A substantially moisture tight container and lid assembly for storing and packaging moisture-sensitive items comprising an assembly with a container and a lid, the lid is attached by a hinge to an upper housing portion of the container, the container has a container base, and a sidewall depending upwardly from the base, a top container surface extends inward from the sidewalls, the top container surface is provided with an opening that permits access to the interior of the container, the lid portion has a lid base with an outer periphery that extends over at least a portion of the container portion, the lid base is provided with a skirt that depends downwardly from the base portion, the skirt is configured at a location on the base portion that allows the skirt to enter into a sealing relationship with the container portion, the lid includes a member that depends downwardly from the lid, the member is configured to abut at least a portion of the interior side of the container when the lid is in the closed position resulting in a substantially moisture tight seal between the lid and the lid, and the container assembly further comprising a base portion and an upper housing portion, the upper housing portion is capable of being snap-fit into the base portion by employing a mechanical interference to form a substantially moisture-tight seal.

6 Claims, 15 Drawing Sheets

U.S. PATENT DOCUMENTS

| | | | | | |
|---|---|---|---|---|---|
| 3,967,756 | A | | 7/1976 | Barish | |
| 3,986,479 | A | | 10/1976 | Bonk | |
| 3,994,417 | A | | 11/1976 | Bodecker | |
| 4,036,360 | A | | 7/1977 | Deffeyes | |
| 4,281,778 | A | | 8/1981 | Stull | |
| 4,730,731 | A | | 3/1988 | Allison | |
| 4,759,463 | A | | 7/1988 | Mazoin | |
| 4,964,539 | A | | 10/1990 | Mueller | |
| 5,145,646 | A | | 9/1992 | Tyranski | |
| 5,379,897 | A | * | 1/1995 | Muckenfuhs et al. | 206/494 |
| 5,437,386 | A | | 8/1995 | Von Holdt | |
| 5,542,567 | A | | 8/1996 | Julius | |
| 5,699,912 | A | | 12/1997 | Ishikawa | |
| 5,842,486 | A | | 12/1998 | Davis | |
| 5,911,937 | A | * | 6/1999 | Hekal | 264/255 |
| 6,080,350 | A | | 6/2000 | Hekal | |
| 6,092,690 | A | | 7/2000 | Bitowft | |
| D443,450 | S | | 6/2001 | Ruhotas | |
| 6,412,634 | B1 | * | 7/2002 | Telesca et al. | 206/494 |
| 6,951,292 | B2 | | 10/2005 | Bando | |
| 7,213,720 | B2 | * | 5/2007 | Giraud | 220/839 |
| 7,537,137 | B2 | * | 5/2009 | Giraud | 220/839 |
| 7,753,228 | B2 | | 7/2010 | Yuhara | |
| 2004/0173612 | A1 | | 9/2004 | Giraud | |
| 2005/0258174 | A1 | | 11/2005 | Giraud | |
| 2006/0196524 | A1 | | 9/2006 | Yuhara | |
| 2007/0023317 | A1 | | 2/2007 | Brozell | |
| 2009/0200326 | A1 | | 8/2009 | Giraud | |
| 2009/0236357 | A1 | | 9/2009 | Giraud | |

FOREIGN PATENT DOCUMENTS

| | | |
|---|---|---|
| WO | 0046118 | 8/2000 |
| WO | 2006045087 | 4/2006 |
| WO | 2008122771 | 4/2007 |
| WO | 2008146171 | 5/2007 |
| WO | 2008153953 | 6/2007 |
| WO | 2008153954 | 6/2007 |
| WO | 2009125267 | 10/2009 |

* cited by examiner

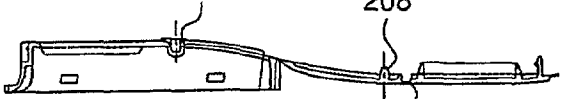
FIG. 12M
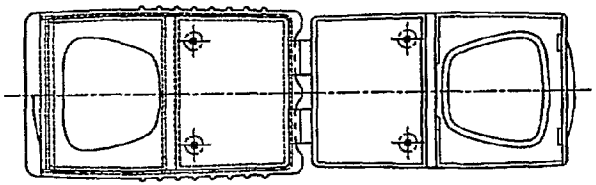
FIG. 12N
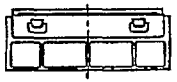
FIG. 12A
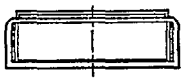
FIG. 12B
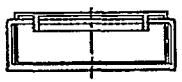
FIG. 12C
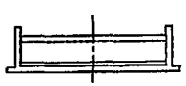
FIG. 12J
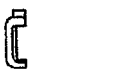
FIG. 12D
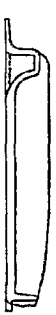
FIG. 12E
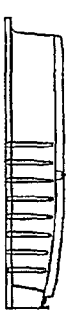
FIG. 12F
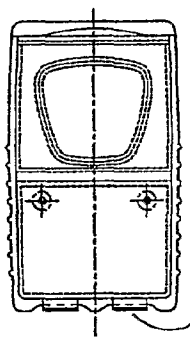
FIG. 12G
FIG. 12H
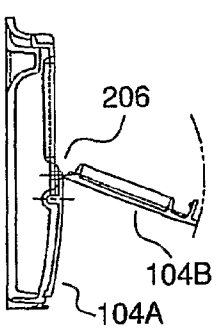
FIG. 12I
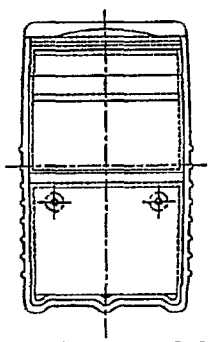
FIG. 12K
FIG. 12L

RE-SEALABLE MOISTURE TIGHT CONTAINERS FOR STRIPS AND THE LIKE HAVING ALTERNATIVE SEALING MECHANISMS

FIELD OF THE INVENTION

The present invention relates to a resealable container and cap assembly for storing and packaging moisture-sensitive items, including but not limited to edible breath-freshening strips, drug-delivery strips, diagnostic test strips, and effervescent tablets.

SUMMARY OF THE INVENTION

The present invention relates to a re-sealable container and cap assembly for storing and packaging moisture-sensitive items, including but not limited to edible breath-freshening strips, drug delivery strips, diagnostic test strips, and effervescent tablets.

The container substantially prohibits the ingress of moisture into the container through the lid when the container is sealed. In other words, it is substantially moisture-proof. In another aspect of the invention, the container assembly is provided with a desiccant or similar material, which reduces the moisture present within the container when it is sealed. That is, after the container has been sealed, the desiccant absorbs moisture present therein. Likewise, after the container has been opened and then resealed, the desiccant absorbs moisture that entered the cavity when the container was opened.

In one embodiment of the present invention, the assembly comprises a cap and container that may be attached by a hinge. The hinge has a recess. The recess forms two elements, the first element being attached to the cap portion and the second element being attached to the container portion. In still a further embodiment, the recess functions as a bending point during the opening and closing of the container assembly.

The container has a sidewall depending downwardly from a top container surface. A bottom container surface is joined to the sidewall. The top container surface is provided with an opening, permitting access to the interior of the container. The opening is bounded by a lip that depends upward from the top container surface. A rim is positioned on the outside of the upper end of the lip.

The cap portion of the assembly is attached to the container portion by a hinge. The cap portion has a base portion with an outer periphery that extends over the container portion. In one embodiment, a portion of the base portion serves as a tab for facilitating the opening and closing of the container assembly. In yet another embodiment, the base portion is provided with a skirt that depends downwardly from a central portion of the base portion. The skirt is positioned at a location on the base portion that allows the skirt to enter into a closing relationship with lip of the container portion, in which the skirt of the base portion fits over the periphery of the lip provided on the top container surface (or, as the case may be, the skirt fits within the periphery of the lip). The skirt of the base portion has an end distal to where the skirt joins the cap portion. At the distal end of the skirt, the skirt is provided with an inward extension, which extends around the interior periphery of the skirt. Similarly, the lip of the container portion is provided with an end distal to where the lip joins the container portion, and the distal end of the lip is provided with an outward facing extension, which extends around the periphery of the lip. In effect, the extension on the skirt and the extension on the lip face each other. In constructing this arrangement on the skirt and lip, the extensions will abut and interlock with each other when the cap is closed on the container portion. In this arrangement, the interlocking, abutting extensions will form at least a substantially moisture-tight sealing arrangement with each other.

In yet another embodiment, a lip seal member depends downwardly and extends around the cap portion. The lip seal member is positioned interior to the skirt, which also depends downwardly from the base portion. Further, the lip seal member is positioned to lie interior of the lip extending upward from the container portion. When the cap is in the closed position, the lip seal member abuts the interior side of the distal end of the lip. In this arrangement, the lip seal (1) provides a sealing position, in addition to the one between the skirt and the lip; and (2) applies pressure on the lip from the inside out, which in turn applies pressure on the skirt, thereby applying tightening the seal between the skirt and the lip.

In yet another embodiment, the cap and/or container contain a desiccant, in the shape of a disc (e.g. puck), sleeve, or other desired shapes.

In yet another embodiment, the assembly includes an elastomeric liner applied to selected regions of the assembly. For example, elastomeric liner may be positioned on the interior surface of the cap, between the skirt and where the lip seals are provided, it may line the lip seals as well.

In yet another embodiment, the skirt depending downward from the base portion has a distal end that is provided with an inward extension. The lip has an end distal to the location where the lip joins the container top surface, where the recess is positioned. The recess is adapted to receive the extension when the cap portion is closed upon the container portion.

In one embodiment, the containers of the present invention have a relatively small height dimension, making them well adapted to fit in a handbag, purse, or pocket. Despite this small height dimension, the container is well suited to storing items such as candies, edible breath-freshening strips, and diagnostic test strips, such as those employed in testing blood glucose levels.

In yet another embodiment, the opening of the container is irregular in its shape, not having a uniform radius. In other words, it is not circular.

In a further embodiment, the containers of the present invention has an upper and lower portions. The upper and lower portion are sealed to form a moisture tight seal. In one example, after the container is filled with the desired moisture-sensitive items, the lower portion is sealed with a barrier film. In another example, after the container is filled with the desired moisture-sensitive items, the lower portion is sealed to the upper portion by employing a snap-fit mechanism. In a further example, after the container is filled with the desired moisture-sensitive items, the lower portion is sealed to the upper portion by employing an elastomer and/or gasket arrangement. In yet a further example, after the container is filled with the desired moisture-sensitive items, the lower portion is sealed to the upper portion by ultrasonic welding.

BRIEF DESCRIPTION OF THE DRAWINGS

FIGS. 12A to 12N show views of yet another embodiment of the present invention;

FIGS. 17 and 18 are side perspective views of one embodiment of the present invention illustrating a mechanical interference fit and wherein FIG. 18 is a blow-up view of the mechanical interference fit.

DETAILED DESCRIPTION OF THE EMBODIMENTS

Figure 1:
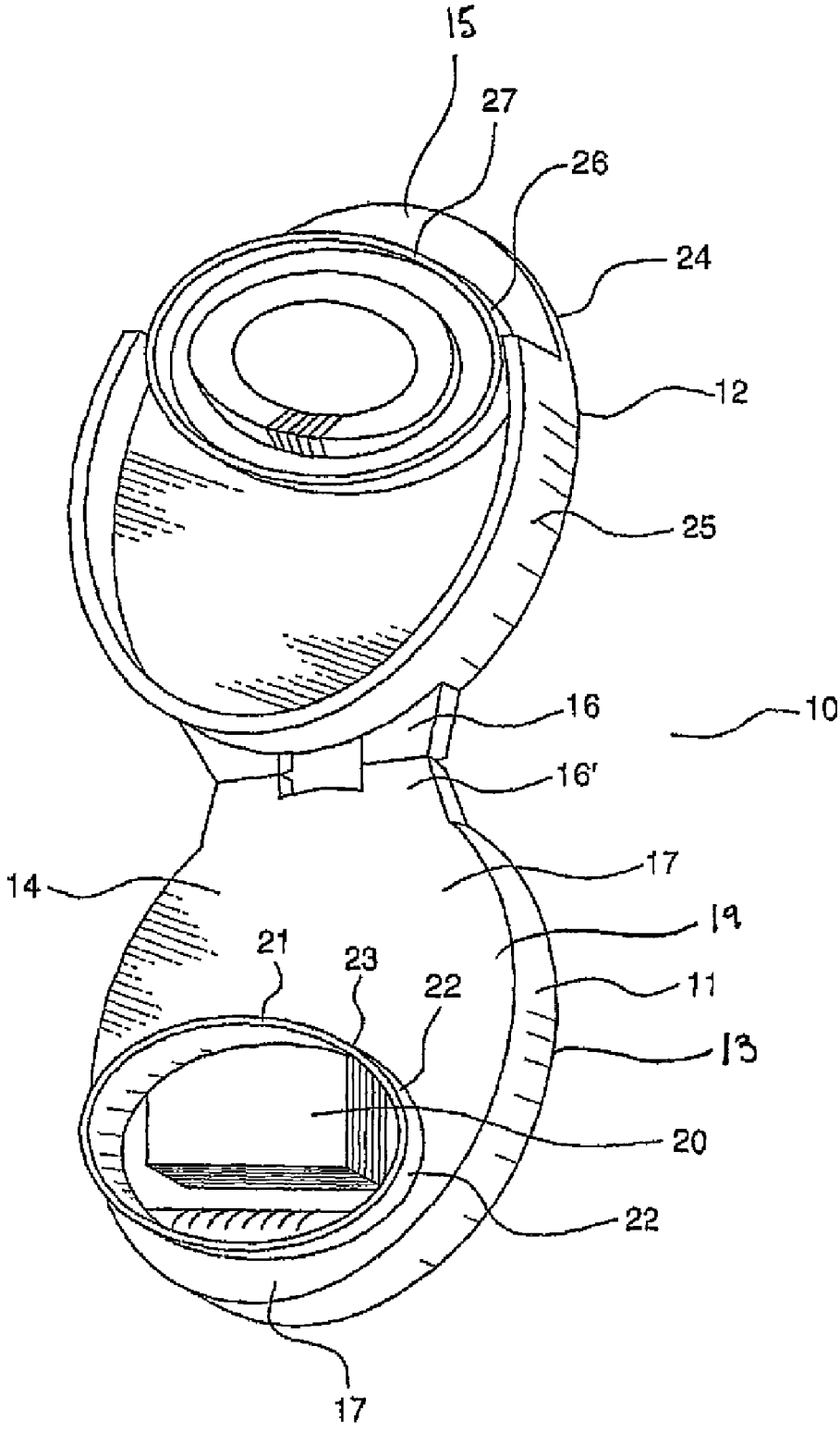
FIG. 1 is a perspective view of one embodiment of the container of the present invention.

The container and cap assembly for storing and packaging moisture-sensitive items, including but not limited to edible breath-freshening strips, drug-delivery strips, diagnostic test strips, and effervescent tablets, substantially prohibits the ingress of moisture into the container through the lid when the container and cap are sealed.

The assembly 10 is generally provided with a cap portion 12 and container portion 14 that are attached by a hinge 16. The hinge 16 has a recess 16'. The recess 16' forms two elements, the first element being attached to the cap portion and the second element being attached to the container portion In still a further embodiment, the recess functions as a bending point during the opening and closing of the container assembly.

The container portion has a container base 13, and a sidewall 11 depending upwardly from the base 13. A top container surface 17 extends inward from the sidewalls, the top container surface 17 and sidewall 11 together defining an upper housing portion 19 of the container portion. The top container surface 17 is provided with an opening 20, permitting access to the interior of the container. The opening 20 is bounded by a lip 22 that extends upward from the top container surface 17. Lip 22 extends around the periphery of the opening 20. The lip 22 has an end 21 distal to the location where the lip joins the container top surface, where an extension 23 is positioned and faces outward, relative to the opening 20. The extension 23 extends around the periphery of the lip distal end 21.

The cap portion 12 has a base portion 24 with an outer periphery 25 that extends over at least a portion of the container portion. In one embodiment, a portion of the base portion 24 serves as a tab 15 for facilitating the opening and closing of the container assembly. The base portion 24 is provided with a skirt 26 that depends downwardly the base portion. The skirt 26 is positioned at a location on the base portion 24 that allows the skirt 26 to enter into a closing relationship with lip 22 of the container portion 14, in which the skirt 26 of the base portion 24 fits over the periphery of the lip 22 provided on the top container surface (or, as the case may be, the skirt fits within the periphery of the lip). The skirt 26 of the base portion 24 has an end 27 distal to the end at which the skirt joins the cap portion. At the distal end 27 of the skirt, the skirt is provided with an inward extension 28, which extends around the interior periphery of the skirt. At the distal end 27 of the skirt, the skirt is provided with an inward facing extension 28, which extends around the periphery of the skirt distal end 27. When the cap portion is closed on the container portion, the extension 28 on the skirt 26 and the extension 23 on the lip 22 face each other. Further, when the cap portion is closed on the container portion, the extensions will abut and interlock with each other. In this arrangement, the interlocking, abutting extensions will form a moisture-tight seal with each other.

Figure 3:
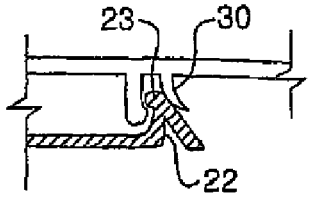
FIG. 3 is a side elevational view of a lip seal one embodiment for a container of the present invention.
Figure 4:
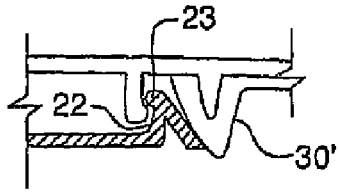
FIG. 4 is a side elevational view of another lip seal one embodiment for a container of the present invention.

In yet another embodiment, a lip seal member 30 depends downwardly and extends around the inside of the cap portion 12. The lip seal member 30 is positioned interior to the skirt 26 which also depending downwardly from the base portion 24. Further, the lip seal member 30 is positioned to lie interior of the lip 22 that extends upward from the container portion 14, and abut the interior side of the distal end of the lip 22, when the cap is in the closed position. In this arrangement, as shown in FIG. 3, the lip seal (1) provides a sealing position, in addition to the one between the skirt and the lip; and (2) applies pressure on the lip from the inside out, which in turn applies pressure on the skirt, thereby applying tightening the seal between the skirt and the lip. FIG. 4 shows a component 30' present as a hollowed out member.

Figure 10:
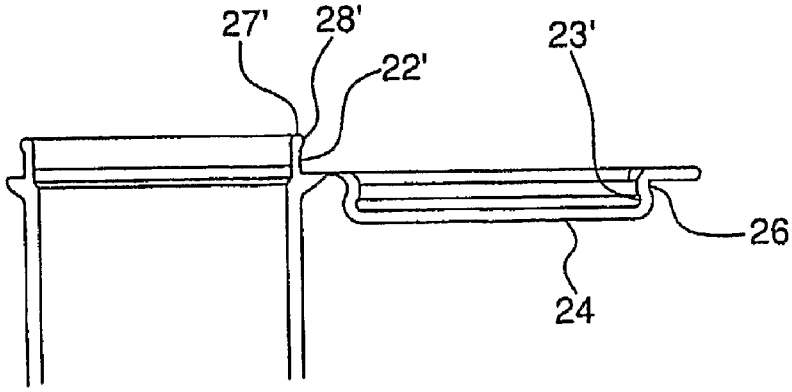
FIG. 10 is a cross sectional view of another embodiment of a container of the present invention.
Figure 11:
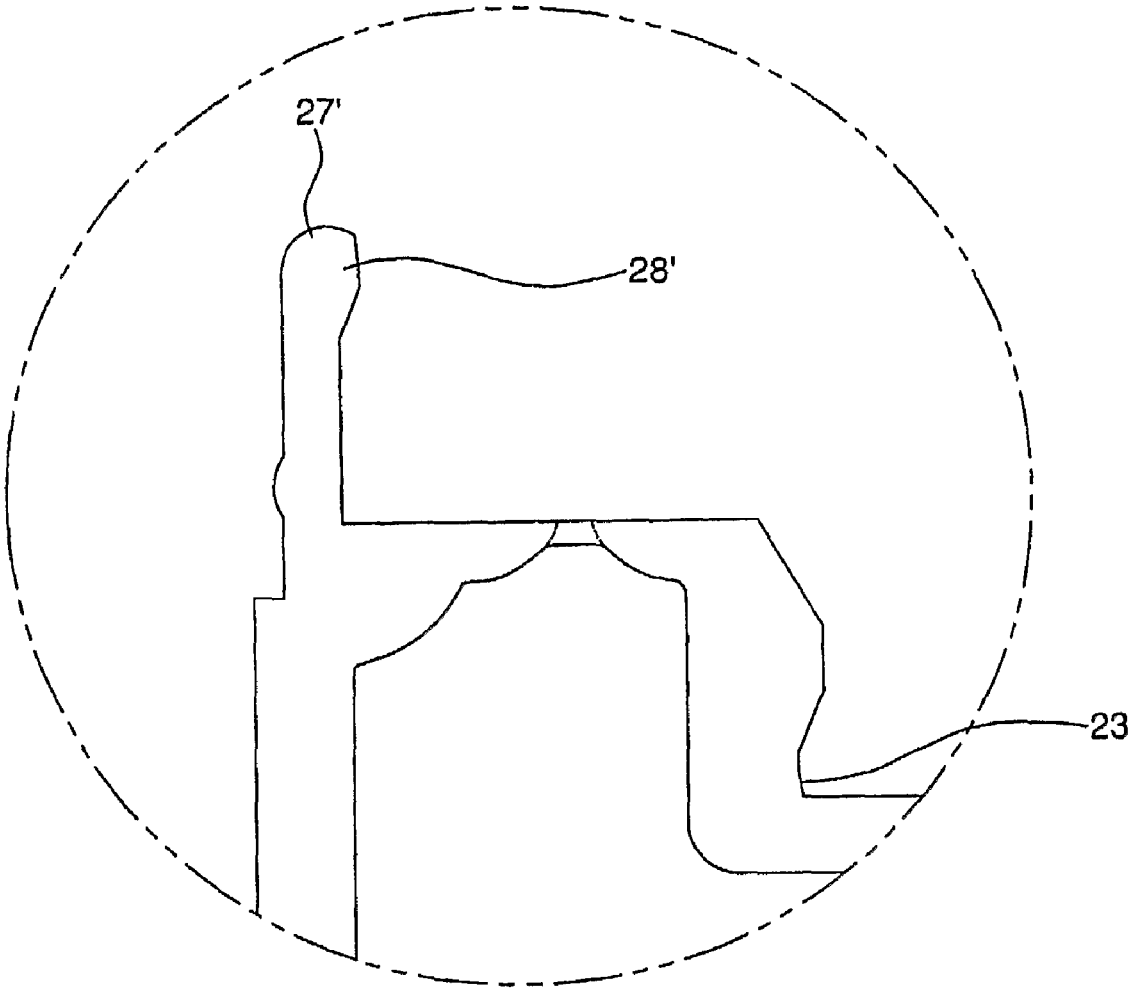
FIG. 11 is a perspective view showing features of the embodiment of FIG. 10.

In yet another embodiment, shown in FIGS. 10 and 11, the structure of the lip 22' has a distal end 27' provided with an extension 28'. The skirt 26' has a recess 23' positioned near where the skirt depends from the base portion 24'. The recess 23' is adapted to receive the extension 28' when the cap portion is closed upon the container portion. When the cap portion is closed on the container portion, the abutting arrangement between the lip and the skirt, and presence of the extension within the recess, forms a substantially moisture tight seal. FIG. 11 shows the configuration for such an arrangement.

Figure 2:
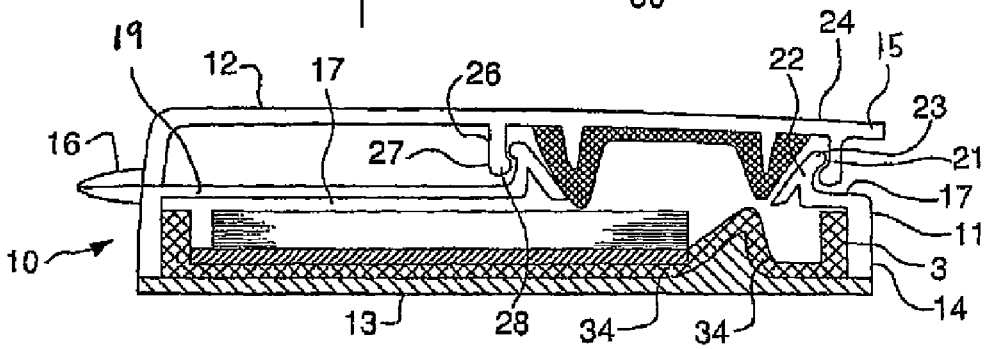
FIG. 2 is a cross sectional view of one embodiment of the container of the present invention.
Figure 5:
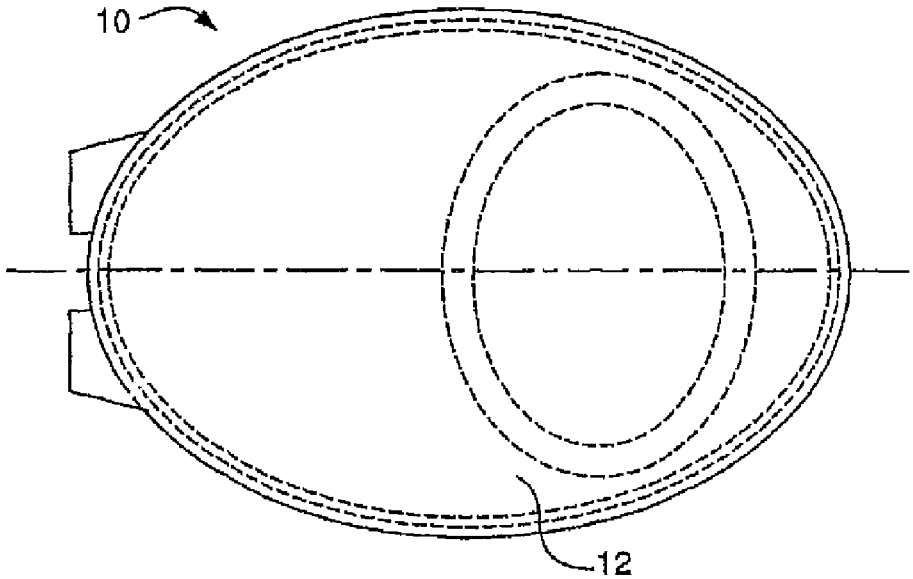
FIG. 5 is a top plan view of one embodiment of the container of the present invention.
Figure 6:
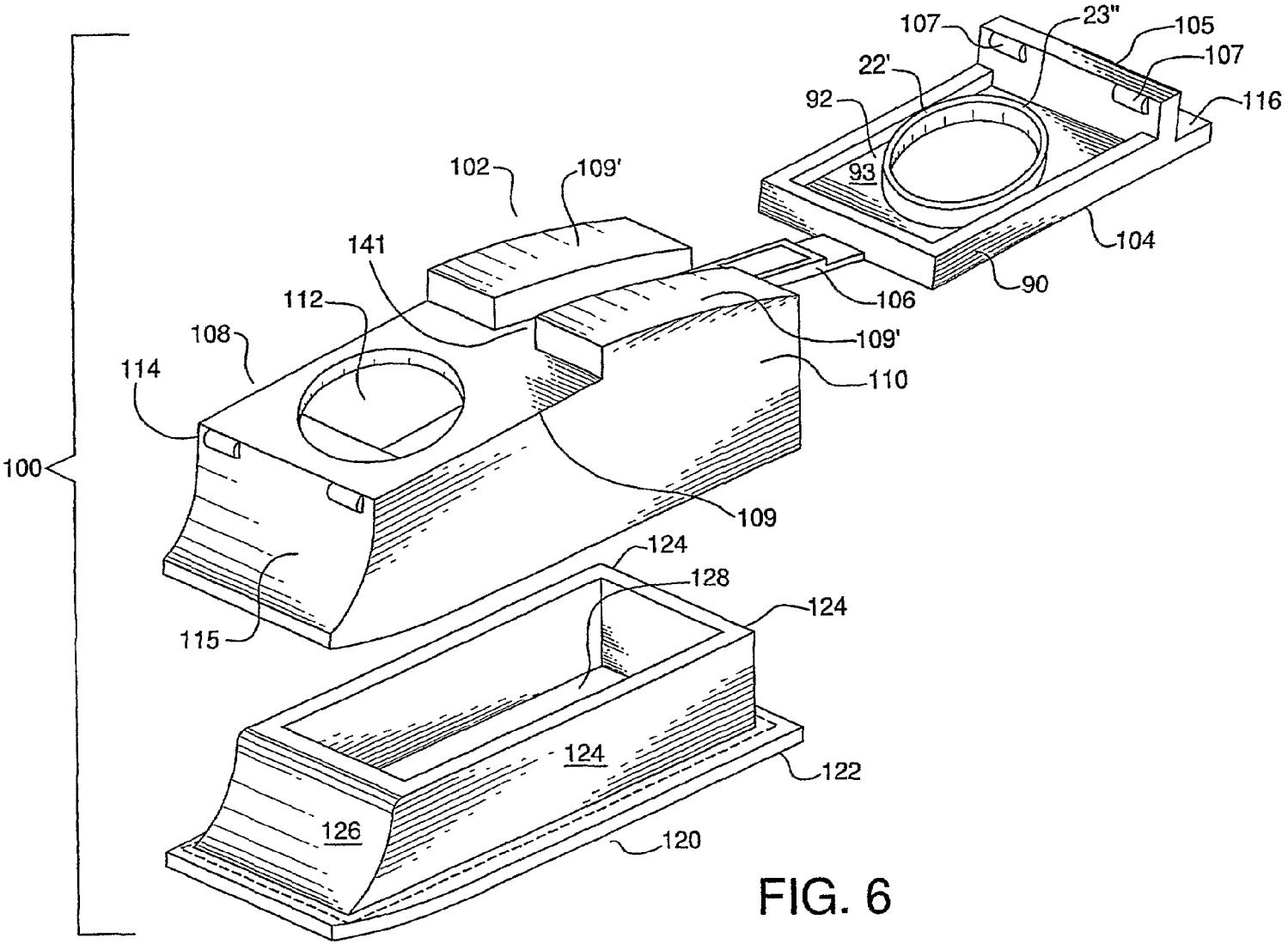
FIG. 6 is an exploded view of one embodiment of the container of the present invention.

In yet another embodiment, the cap and/or container contain a desiccant, in the shape of a disc (e.g. puck), sleeve, or other shapes. In one embodiment, a desiccant entrained plastic is located in a desiccant liner that covers at least a portion of the cap and/or container, such as the desiccant-entrained plastic sleeve 34 positioned at the bottom of the container. See FIG. 2, where the sleeve 34 is shown surrounding the item stored within the container on three of the item's sides. In one embodiment, such a sleeve or liner can surround the stored item(s) on more or less than three sides. See, e.g., FIG. 7, where the desiccant insert is positioned on the container base. When the container assembly is repeatedly opened and closed, the desiccant-entrained plastic sleeve re-establishes the low relative humidity environment inside the container assembly in a short period of time (e.g. in as low as less than about one minute), when a desiccant, such as the sleeve of FIG. 2, is included in the assembly.

The desiccant-entrained plastic contains a desiccant such as silica gel or molecular sieve as the desiccant. Depending on the application, such as the application intended by the end user, molecular sieve or silica gel desiccant can be provided in the sleeve. For example, molecular sieve can be used for applications that require a low RH (e.g. less than <10% RH) maintained over the shelf life. In another example, silica gel can maintain a RH of 10-30% over a two-year shelf life.

Suitable desiccant entrained plastic include, but are not limited to, these desiccant plastics disclosed in U.S. Pat. Nos. 5,911,937, 6,214,255, 6,130,263, 6,080,350 and 6,174,952, 6,124,006, and 6,221,446. These references are incorporated herein by reference. By varying the desiccant loading and channeling agent in the plastic formulation, the overall moisture capacity and uptake rate of the desiccant entrained plastic can be controlled. In embodiments where containers include desiccant material, they may be formed by two shot molding techniques.

In yet another embodiment, the assembly includes an elastomeric liner 36 applied to selected regions of the assembly. For example, elastomeric liner may be positioned on the interior surface of the cap portion, lying inside the skirt. Where the lip seals are provided, it may line them as well. In one example, a suitable elastomer is EPDM, commercially available under the trade name Santoprene.

The containers of the present invention are formed of plastic materials, by injection molding or other suitable molding techniques. For example, the containers may be molded of polypropylene. In one embodiment, the containers can be formed as a single closed unit, with the hinge joining the cap portion to the container portion. Alternatively, the pieces can be molded separately, the container portion can be loaded with the item to be retained in the container, and then the container and cap portion can be snap-fit together and/or welded, in order to provide moisture-tightness. In yet another embodiment, the cap and container portions can be formed as separate parts, loaded with the desired item, the container and cap can be fit together, and the parts joined, e.g., by welding (such as by sonic welding or by thermal welding). In yet another embodiment, the cap and container can be formed in a single piece (for example, joined at the hinge), yet open, as in a clamshell arrangement. The assembly can be filled with contents, closed shut, and then joined, e.g., welded to form a seal, as described above.

Figure 7:
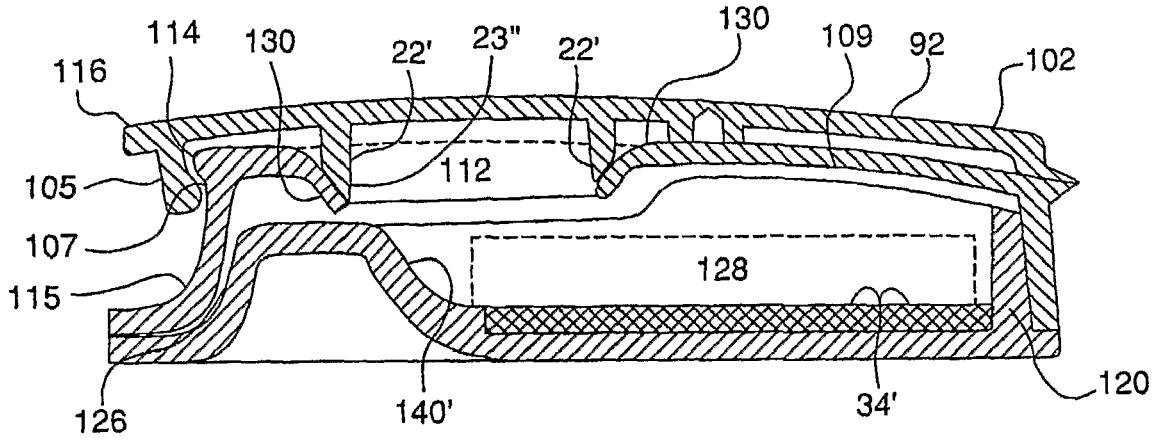
FIG. 7 is a cross sectional view of one embodiment of the container of the present invention.
Figure 7A:
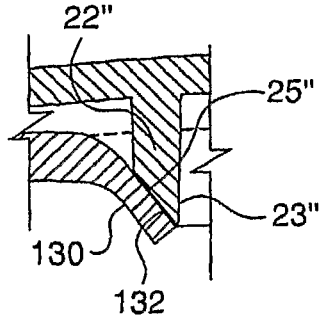
FIG. 7A is a perspective view of a feature shown in the FIG. 7 embodiment.

An embodiment depicting a two-part assembly is illustrated in FIGS. 6 to 9 and 12. In this embodiment, assembly 100 is provided with cover component 102 and tray component 120. The cover component 102 has a cap portion 104 that is joined to upper component 108 by hinge 106. As shown, cap portion 104 has sidewalls 90 located at the periphery of the cap base 92. The hinge 106 is joined to one of the sidewalls 90. Within the space of the sidewalls, the underside of the cap base 92 has a recess 93 in which the lip 22", depending from the cap base 92, is located. As shown in FIG. 7, the lip 22", which extends in a loop around a portion of the cap base 92, is positioned to be received in the opening 112 of upper component 108, when the cap portion is closed on the opening 112. The lip 22" is provided with an end 23" distal to where the lip 22" is joined to the cap base 92. As best seen in FIG. 7A, the distal end 23" of lip 22" has a tapered edge 25", which is adapted to lie substantially flush against the surface 132 of the edge 130, when the lip 22" of the cap portion 104 is closed on the opening 112 of the upper component 108. Thus, when the cap portion 104 is closed on the opening 112 of the upper component 108, the tapered edge 25" of the lip 22" lies substantially flush against the flexible edge 130 surrounding the opening 112 in the top surface 109 of the cover component 102.

At the end of the cap portion 104 that is opposite the hinge, cap latch component 105, depending from the cap base 92, is located. In one embodiment, hooks 107 are provided on the cap latch. 105. In another embodiment, a tab 116, to facilitate opening of the cap portion, when it is closed on the opening 112, is provided on the cap portion.

Upper component 108 has top wall 109 from which sidewalls 110 and sloped wall 115 depend downward. Opening 112 is provided in the top wall 109. In the embodiment relating to hooks, hooks configured to mate with and compliment the hooks 107 on the cap portion 104 are positioned at one end of the upper component 108. At the end opposite where the hooks are positioned, hinge 106 is joined to the upper component 108. The upper component may have a recess 111 for the hinge 106, positioned between elevated portions 109' of top wall 109.

The tray component 120 is provided with sidewalls 124 and sloped wall 126 depending upward from the base of the tray 122. Sloped wall 126 is complimentary in its shape to the sloped wall 115 of the upper component 108. The side walls define a cavity 128 where items can be stored.

As best seen in FIG. 7, the edges 130 of the opening 112 provided in the top wall 109 are formed of a flexible plastic material that slopes downward, into the opening 112. The edges extend around the periphery of the opening 112.

Again, seen in FIG. 7A, the distal end 23" of lip 22" has a tapered edge 25", which is adapted to lie flush against the surface 132 of the edge 130, when the lip 22" of the cap portion 104 is closed on the opening 112 of the upper component 108. Thus, when the cap portion 104 is closed on the opening 112 of the upper component 108, the tapered edge 25" of the lip 22" lies flush against the flexible edge 130 surrounding the opening 112 in the top surface 109 of the upper component 108, thereby sealing the opening from substantial moisture ingress.

In the closed position (FIG. 7), hooks 107, 114, provided on the cap portion 104 and the upper component 108, respectively, are engaged with each other, to maintain the cap portion 104 closed on the upper component 108.

The cover component 102 is adapted to fit over the tray component 120, in order to form a container assembly. The cover component and the tray component can be loaded with items to be dispensed through the opening and then joined together, in the ways previously described herein.

Figure 8:
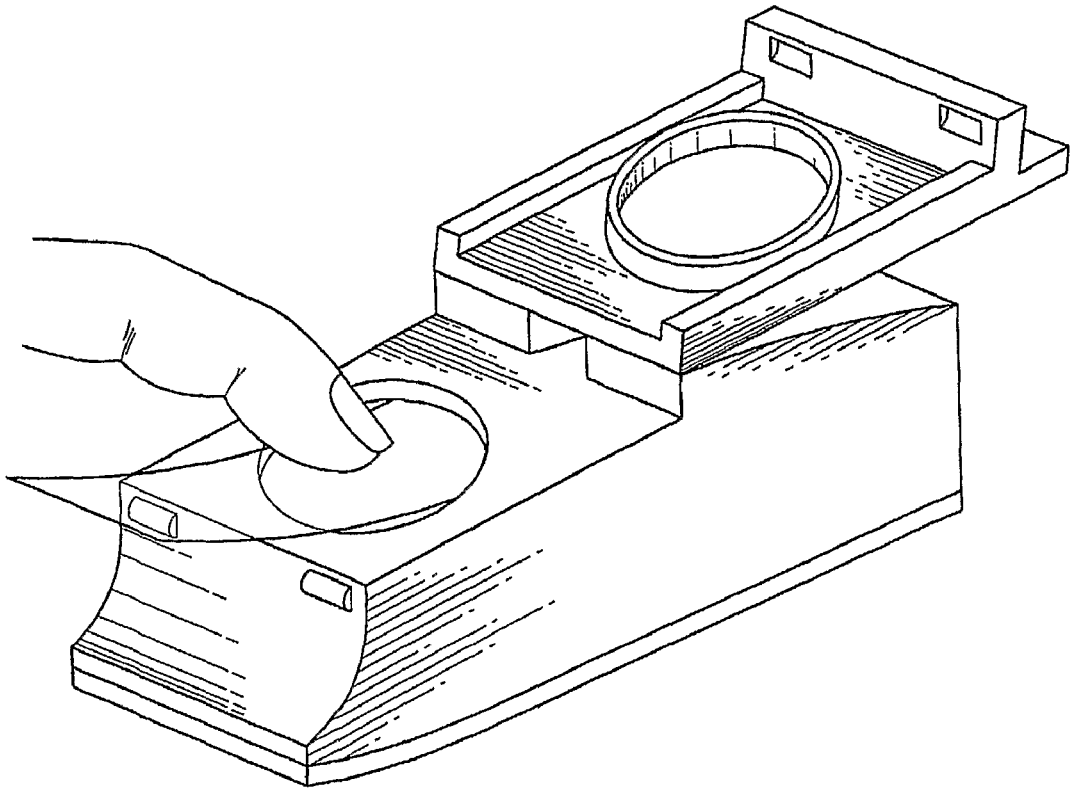
FIG. 8 is a perspective view of one embodiment of the container of the present invention, as an item is removed from the container.

As seen in FIG. 7, a stack of items is positioned in the container. Opening 112 is sized to permit a person to insert at least a portion of his or her finger therein. As shown in FIG. 8, a person can slide a portion of the index finger inside the hole, sliding an item up the sloped wall of the cavity 128 (FIG. 7), and through the opening.

A desiccant material, such as a desiccant sleeve, can be positioned in the container. As shown in FIG. 7, the sleeve 34' may be positioned along the base 122 of the tray component, or anywhere else along the interior of the assembly, where the item(s) is stored.

Figure 9:
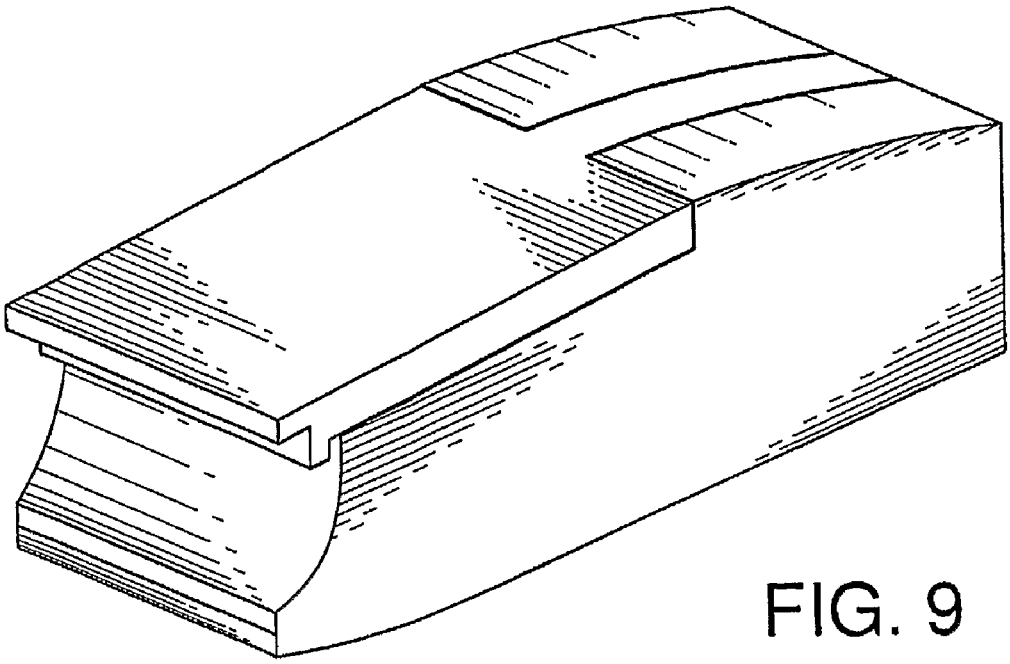
FIG. 9 is a perspective view of one embodiment of the container of the present invention in the closed position.

FIG. 9 shows the assembly in the closed position. It will be readily appreciated that the assembly is relatively compact, and will fit within a purse, handbag, or pocket, without taking up an undesired amount of space.

FIGS. 12A-12N show various views of another embodiment of a container assembly. Features of this embodiment are similar to the features of the embodiment depicted in FIGS. 6-9, with some differences as described here. The shape of the opening is asymmetrical. Also, the cover component 102 has a two hinge arrangement. Hinge 106 is as described above. Hinge 206 joins the first and second cap portions 104A and 104B. The lip of the cap portion is located on component 104B. Cap portion 104B is provided with tabs 208 that depend downward therefrom. Tabs 208 are sized and positioned to be received in recess 210 located on the top wall 109, and are received therein when the cap portion 104B is closed upon the top wall 109. In one embodiment, cap portion 104B may never be opened again, once it has been closed as described herein. The cap portion 104A is opened and shut at hinge 206.

Figure 13B:
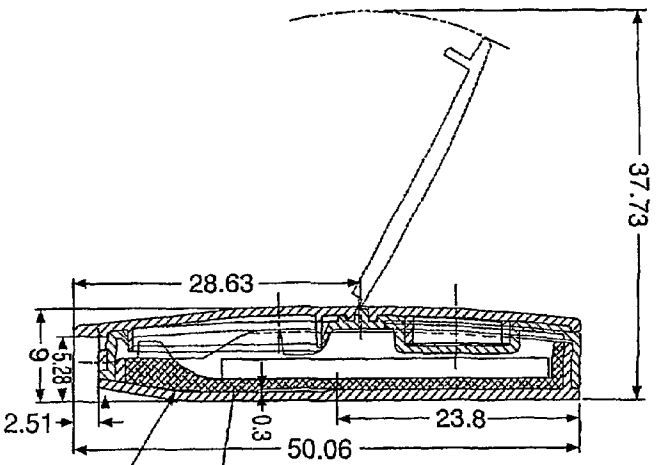
FIGS. 13A to 13E show views of yet another embodiment of the present invention.
Figure 13C:
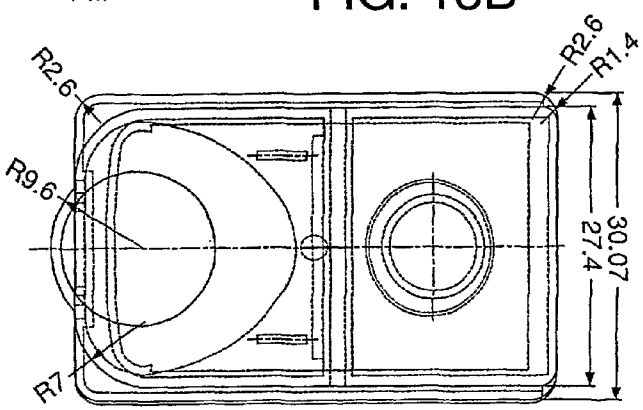
Figure 13A:
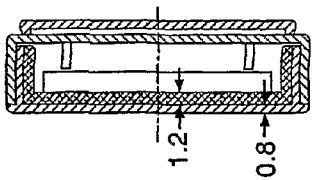
Figure 13E:
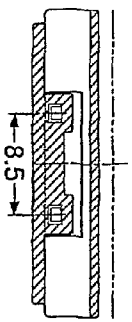
Figure 13D:
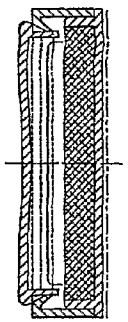

FIGS. 13A-12E show various views of yet another embodiment of a container assembly. Features of this embodiment are similar to the features of the embodiment depicted in FIGS. 1-5 and 6-9. As shown, the shape of the opening is asymmetrical. Also, the cap component has a one hinge arrangement. The hinge joins the lid to a portion of the cap. In use, the cap portion is opened and shut at the hinge with the lid. In one example of constructing the assembly, the container base is made of two materials—at least a portion of the interior of the base is composed of a desiccant entrained plastic and the remaining portion of the base is composed of a substantially water impermeable plastic (e.g. polypropylene, polyethylene). The lid is welded (e.g. ultrasonic welding) to the cap portion. After the container is filled with the desired material, the cap is joined to container (e.g. ultrasonic welding). The result is a moisture tight container.

In one example, the film pieces are about 22 mm wide and about 64 mm long. In another example, the container holds approximately 25 film pieces.

At least some or all of the embodiments of the present invention can be molded according to, for example, techniques disclosed in U.S. Pat. Nos. Re 37,676 (a reissue of U.S. Pat. No. 5,723,085), 4,812,116, and 4,783,056, all of which are incorporated herein by reference.

In yet another embodiment, the container consists of 2-injection molded components that are molded in one-molding operation. One component is the upper housing and the second component is the flip-top closure. The upper housing has an opening along one side of the top surface. This opening provides access by a user to remove the film piece from the container. In one example, the upper housing and flip-top closure is manufactured in one molding operation. In a specific example, the flip-top closure is closed onto the opening in the upper housing in the mold. In yet another specific example, the hinge portion of the flip-top closure is attached to the upper housing ultrasonic welding. This process occurs post molding.

In another embodiment, below the opening in the upper housing is a raised profile, used to guide an individual film strip out of the container by a user. This profile is referred to as the film dispensing guide region. In a specific embodiment, there is space in the upper housing to attach a part made of desiccant entrained plastic. For example, the desiccant entrained plastic is molded in a separate molding operation and is assembled into the upper housing.

Figure 14:
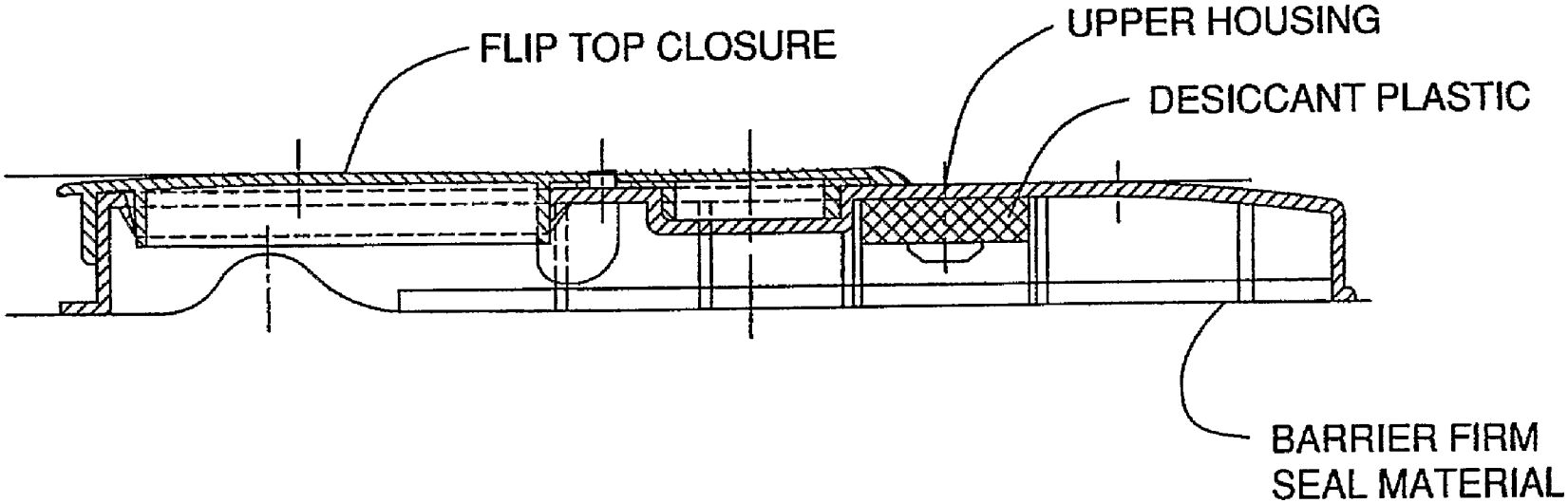
FIGS. 14-16 are perspective views of one embodiment of the present invention where the lower portion of the container has a perimeter that can be sealed with a barrier film.
Figure 15:
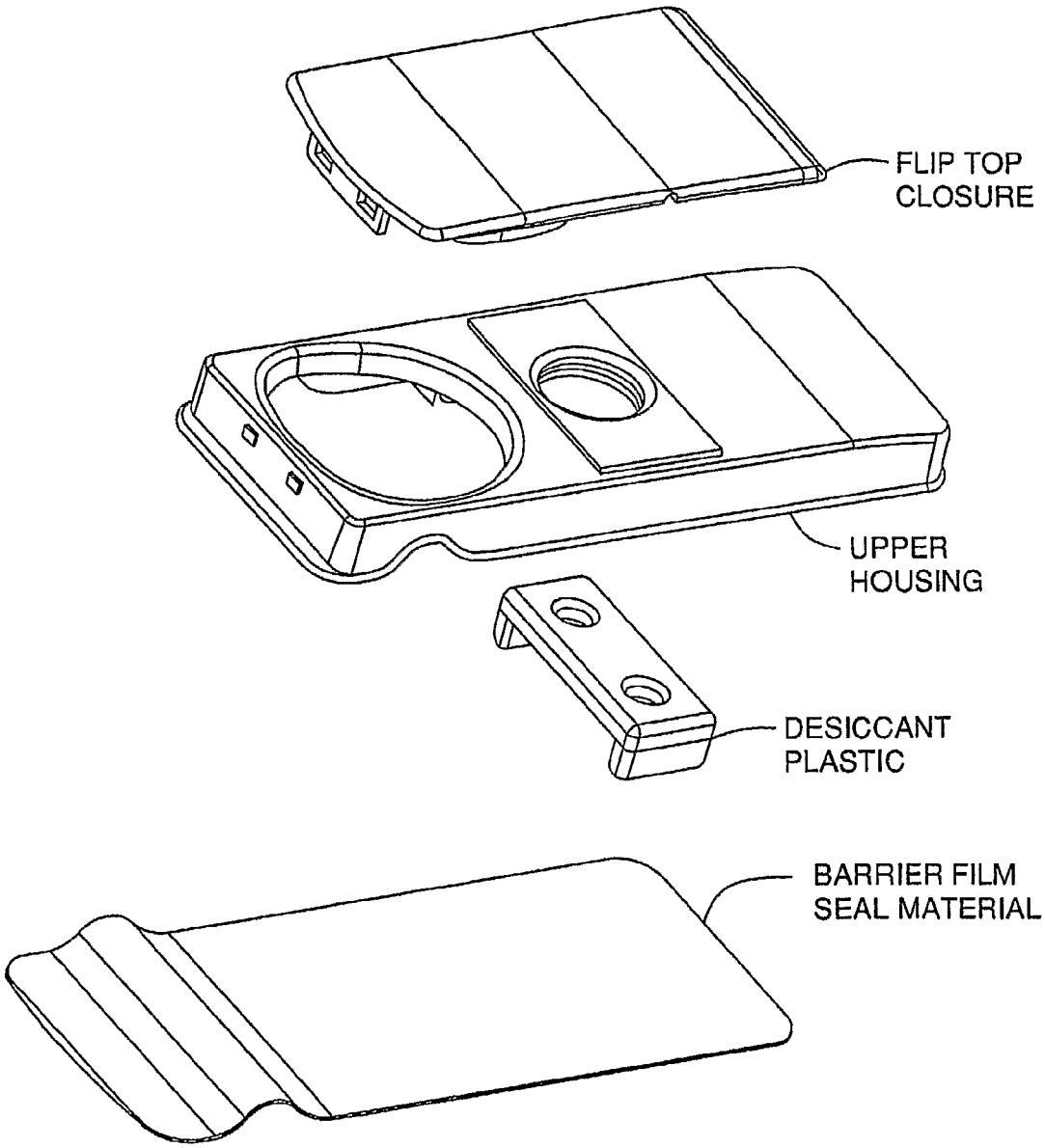
Figure 16:
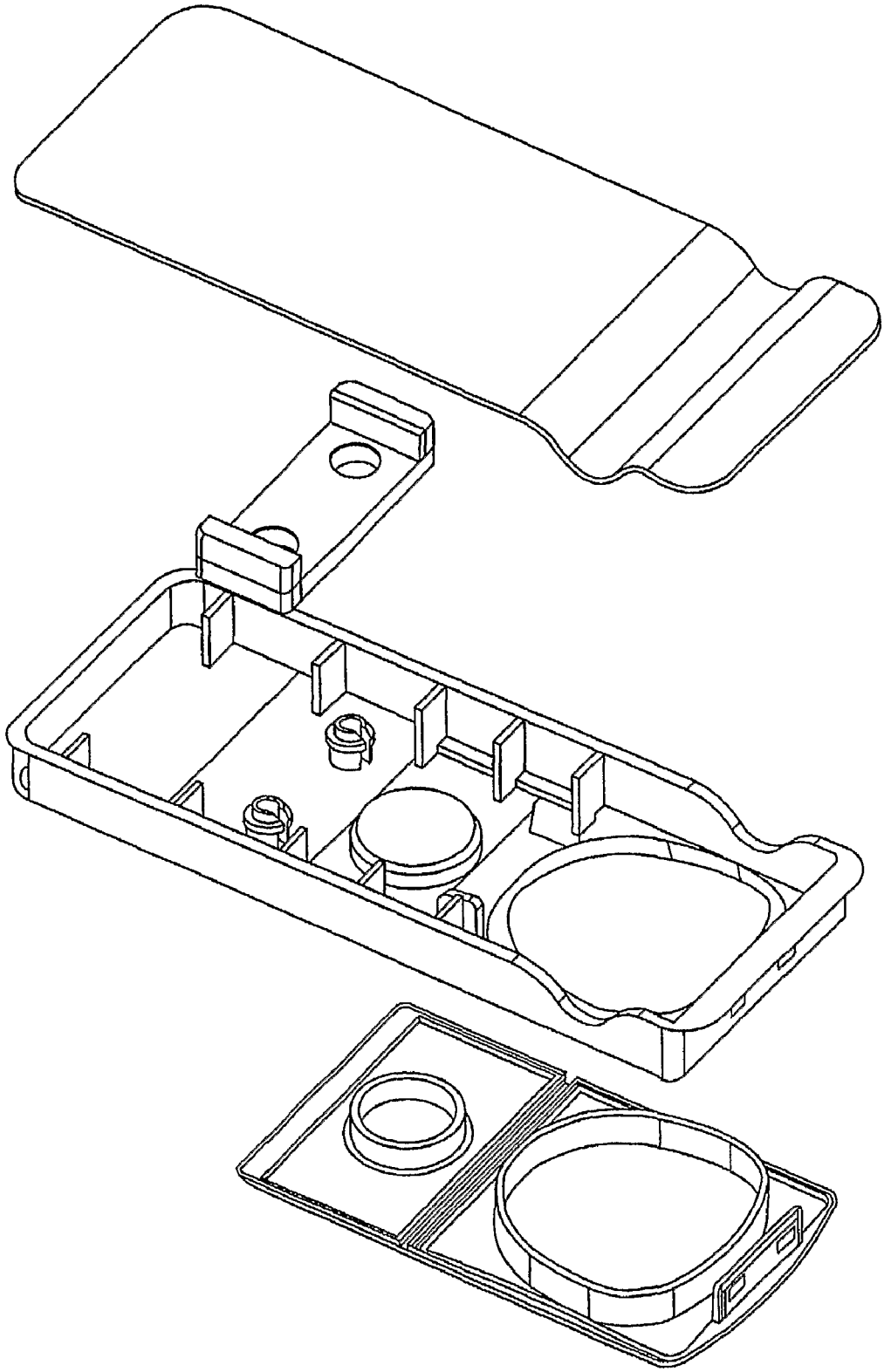

In another embodiment as illustrated by FIGS. 14-16, the container of the present invention has an upper and lower portions. The upper and lower portion are sealed to form a moisture tight seal. In one example, the lower portion of the container has a perimeter that can be sealed with a barrier film (e.g., PVdC, Aclar, Surlyn, cyclic olefins (COCs)). In a specific example of the use of the present invention, the upper portion with the flip-top closure (i.e. the cap and container that is attached by a hinge) is supplied to a manufacturer of the moisture-sensitive items. The upper portion is placed onto a film filling line in an inverted position. In one example of the film, the film is cut, stacked and placed into the upper portion. Subsequently, after filling the container, a barrier film seal is placed over the bottom of the upper portion. In addition to serving as a substantial moisture barrier, the barrier film serves as the base of the container.

In one example, the barrier film is attached to the perimeter of the upper portion by employing an induction, heat seal or other conventional processes. Using an induction seal process, it is important that the barrier film contain a conductive layer (i.e., aluminum). It is understood that the barrier film may be selected, among other reasons, based on the level of moisture protection and/or rigidity needed for the container. In a specific example, the desiccant entrained plastic may be attached to the seal layer of the barrier film, using a heat staking process.

Figure 17:
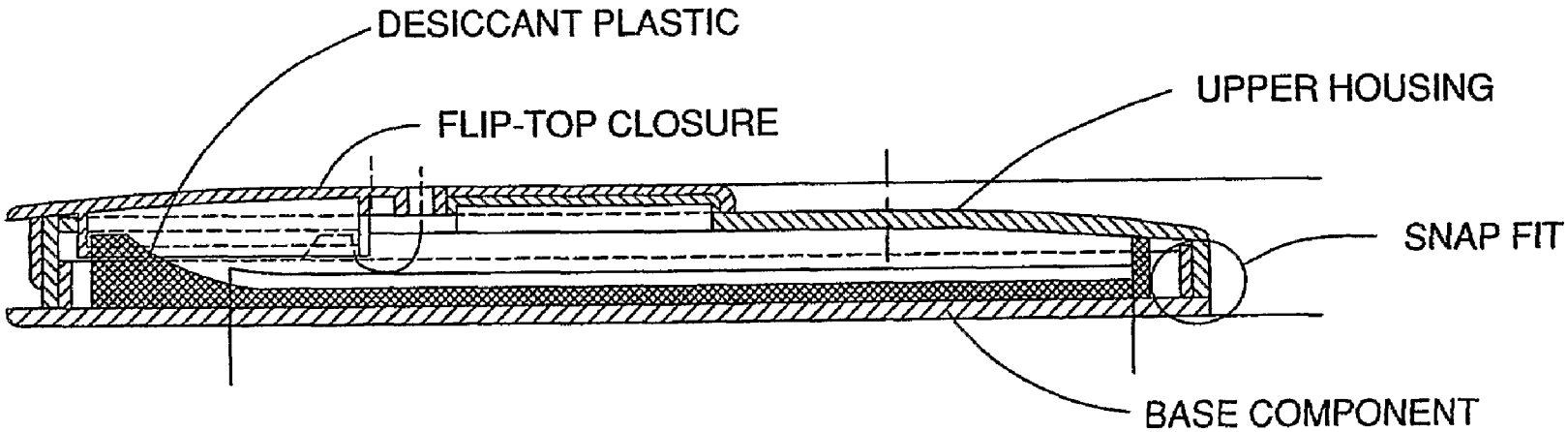
Figure 18:
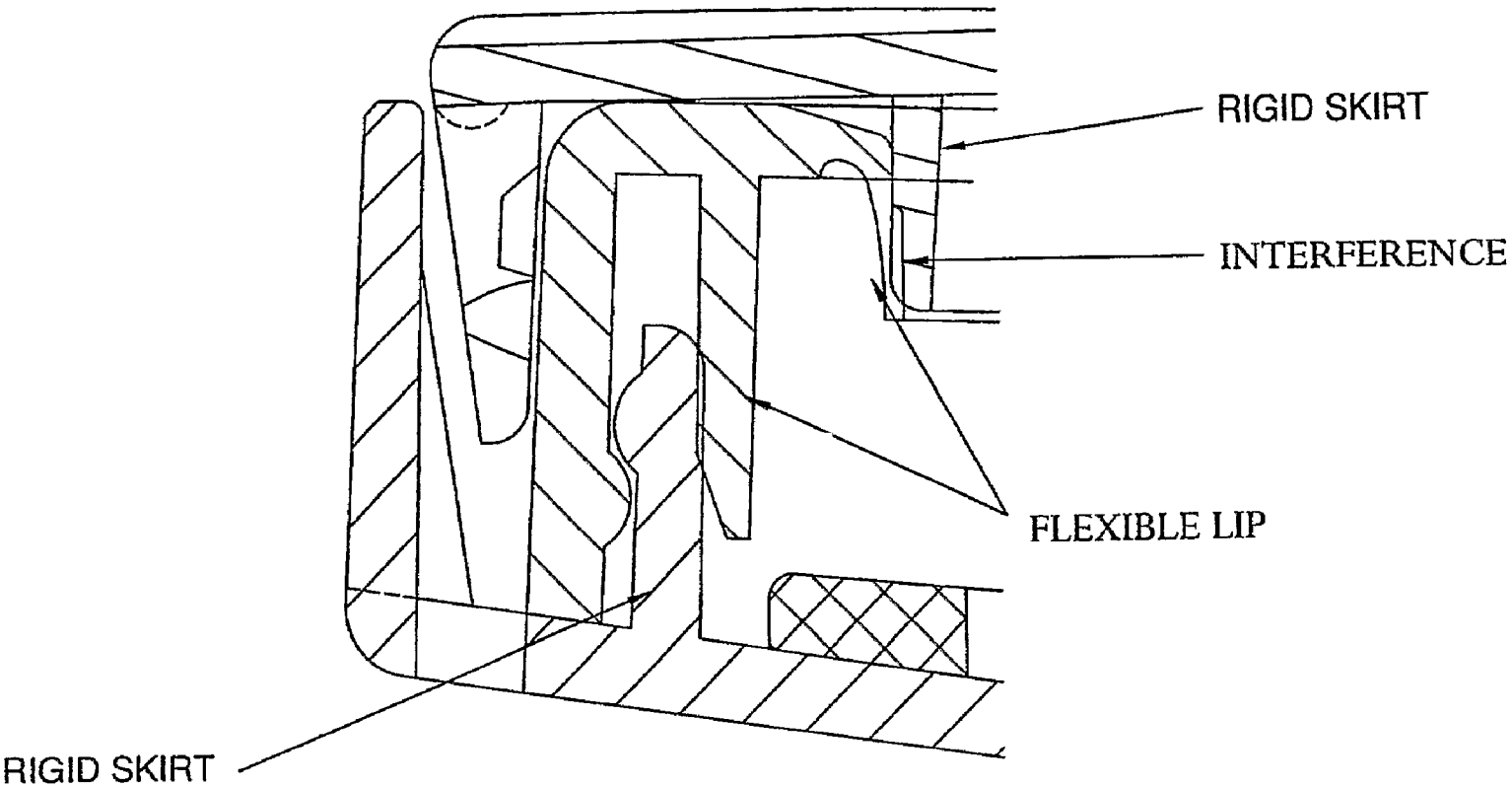

In a further embodiment, as illustrated by FIGS. 17 and 18, a moisture-tight snap fit is created between the upper and lower portion of the container. In one example, the sealing is accomplished by a mechanical interference with a snap fit that holds the upper and lower portion of the container together. As such, no separate sealing station or special sealing equipment is required after product filling. In one example, the container is a substantially oval shape with rounded corners to support the moisture-tight snap fit. In one specific example, the lower portion may incorporate desiccant entrained plastic (e.g. via a 2-shot molding process).

In a specific example of the use of the present invention, the upper portion with the flip-top closure is supplied to a manufacturer of the film products. The lower portion component made of a plastic (e.g. PE or PP) is also supplied to a manufacturer of film products. In one specific example, the lower portion is made as a 2-shot part and includes a desiccant entrained plastic on the inner portion. The lower portion is placed on the assembly line of the filling station. In one example, the film is cut, stacked and placed onto the lower portion. After filling, the upper portion is placed over the filled lower portion and aligned. Subsequently, the upper portion is snapped onto the lower portion and thus, creating the moisture tight container.

Figure 19:
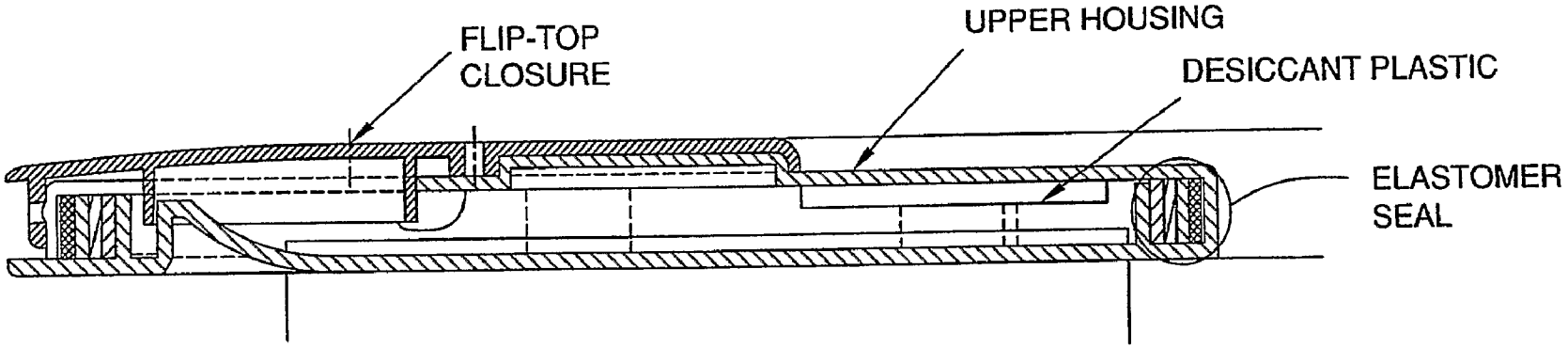
FIG. 19 is a perspective view of one embodiment of the present invention where an elastomeric seal is incorporated between the upper and lower portions to form the moisture tight seal.

In a further embodiment, as illustrated by FIG. 19, an elastomeric seal incorporated between the upper and lower portions to form the moisture tight seal. In one example, the container is a substantially oval shape with rounded corners to support the moisture-tight elastomeric seal. In another example, an elastomeric seal on the lower portion integrates with the upper portion to form a snap fit with the upper portion. As such, no separate sealing station or special sealing equipment is necessarily required after product filling. In a further example, the lower portion is composed of two materials—a thermoplastic resin (e.g., PP or PE) and a thermoplastic elastomer (e.g., Santoprene).

In a specific example of the use of the present invention, the upper portion with the flip-top closure is supplied to a manufacturer of film products. In another example, the upper portion may also contain a desiccant entrained plastic component that is pre assembled into the upper portion before delivery to the film manufacturer. The lower portion is made of materials that are supplied to a manufacturer of the film products. For example, the first material is a thermoplastic (e.g. PE or PP) and the second material is a thermoplastic elastomer (e.g. TPE). As such, thermoplastic elastomer forms a gasket along the perimeter (sealing surface) of the lower portion.

In a specific example of the use of the present invention, the lower portion is placed on the assembly line. In one example, the film is cut, stacked and placed onto the lower portion. After filling, the upper portion is placed over the filled lower portion and aligned. The upper portion is snapped onto the lower portion, creating the moisture tight container. The moisture tight seal is created between the TPE gasket on the upper and the lower portions.

As used herein, the terms "moisture-tight" and "moisture-sensitive" mean the moisture ingress of the container (after three days) was less than about 1500 micrograms of water, preferably, about 750 micrograms of water, more preferably, about 350 micrograms of water determined by the following test method: (a) place one gram plus or minus 0.25 grams of molecular sieve in the container and record the weight; (b) fully close the container; (c) place the closed container in an environmental chamber at conditions of 80% relative humidity and 22 C; (c) after one day, weigh the container containing the molecular sieve; (d) after four days, weigh the container containing the molecular sieve; and (e) subtract the first day sample from the fourth day sample to calculate the moisture ingress of the container in units of micrograms of water.

What is claimed is:

1. A substantially moisture tight container and cap assembly for storing and packaging moisture-sensitive items comprising an assembly with a container and a cap, the cap is attached by a hinge to an upper housing portion of the container, the container has a container base, and a sidewall depending upwardly from the container base, a top container surface extends inward from the sidewall, the top container surface is provided with an opening that permits access to the interior of the container, the cap has a cap base with an outer periphery that extends over at least a portion of the container, the cap base is provided with a skirt that depends downwardly from the cap base, the skirt is configured at a location on the cap base that allows the skirt to enter into a sealing relationship with the container, the cap includes a member that depends downwardly from the cap, the member is configured to abut at least a portion of the interior side of the container when the cap is in the closed position resulting in a substantially moisture tight seal between the container and the cap, and the container assembly further comprising a container base, the upper housing portion defined by the sidewall and the top container surface and a barrier film, the upper housing portion is capable of being snap-fit into the container base with the barrier film placed over a bottom of the upper housing portion to form a substantially moisture-tight seal.

2. The container and cap assembly of claim 1 wherein at least a portion of the interior of the container comprises a desiccant entrained plastic.

3. The container and cap assembly of claim 1 wherein the moisture ingress of the container, after three days, is less than about 1500 micrograms of water.

4. The container and cap assembly of claim 1 wherein the moisture ingress of the container, after three days, is less than about 500 micrograms of water.

5. The container and cap assembly of claim 1, wherein the member is a lip seal member positioned to lie interior of the skirt.

6. The container and cap assembly of claim 5, wherein the opening is bounded by a lip, and the lip seal member is positioned to abut an interior side of the lip when the cap is in the closed position.

* * * * *